US009857712B2

(12) United States Patent
Tsujihiro et al.

(10) Patent No.: US 9,857,712 B2
(45) Date of Patent: Jan. 2, 2018

(54) ELECTROSTATIC LATENT IMAGE DEVELOPING TONER

(71) Applicant: KYOCERA Document Solutions Inc., Osaka (JP)

(72) Inventors: Masami Tsujihiro, Osaka (JP); Jun Hioki, Osaka (JP); Ryotaro Komada, Osaka (JP); Yusuke Washino, Osaka (JP); Haruhiro Nishitera, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/072,048

(22) Filed: Mar. 16, 2016

(65) Prior Publication Data

US 2016/0274479 A1 Sep. 22, 2016

(30) Foreign Application Priority Data

Mar. 19, 2015 (JP) ..... 2015-056379
Jan. 28, 2016 (JP) ..... 2016-014416

(51) Int. Cl.
*G03G 9/097* (2006.01)
*G03G 9/093* (2006.01)

(52) U.S. Cl.
CPC ..... *G03G 9/09321* (2013.01)

(58) Field of Classification Search
CPC ..... G03G 9/08708; G03G 9/08768; G03G 9/08764; G03G 9/1135
See application file for complete search history.

(56) References Cited

U.S. PATENT DOCUMENTS 5,571,651 A * 11/1996 Inaba ..... G03G 9/09321 430/110.2

FOREIGN PATENT DOCUMENTS

JP S59-187351 A 10/1984
JP H04-058017 B 9/1992
JP 2013-088686 * 5/2013 ..... G03G 9/08

OTHER PUBLICATIONS

Translation of JP 2013-088686 published May 2013.*

* cited by examiner

*Primary Examiner* — Peter Vajda
(74) *Attorney, Agent, or Firm* — Studebaker & Brackett PC

(57) ABSTRACT

An electrostatic latent image developing toner includes a plurality of toner particles each including a core and a shell layer. The shell layer is disposed over a surface of the core. The shell layer is substantially formed by a resin. The shell layer has a surface including a plurality of spot regions and a sheet region that is more hydrophobic than the spot regions. The spot regions each are more chargeable than the sheet region.

13 Claims, 4 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2015-056379, filed on Mar. 19, 2015 and Japanese Patent Application No. 2016-14416, filed on Jan. 28, 2016. The contents of these applications are incorporated herein by reference in their entirety.

BACKGROUND

The present disclosure relates to electrostatic latent image developing toners and particularly relates to a capsule toner.

One of known examples of electrostatic latent image developing toners is a capsule toner. Toner particles included in the capsule toner each include a core and a shell layer (capsule layer) disposed over the surface of the core.

SUMMARY

An electrostatic latent image developing toner according to the present disclosure includes a plurality of toner particles each including a toner core and a shell layer. The shell layer is disposed over a surface of the core. The shell layer is substantially formed by a resin. The shell layer has a surface including a plurality of spot regions and a sheet region that is more hydrophobic than the spot regions. The spot regions each are more chargeable than the sheet region.

DETAILED DESCRIPTION

Figure 1:
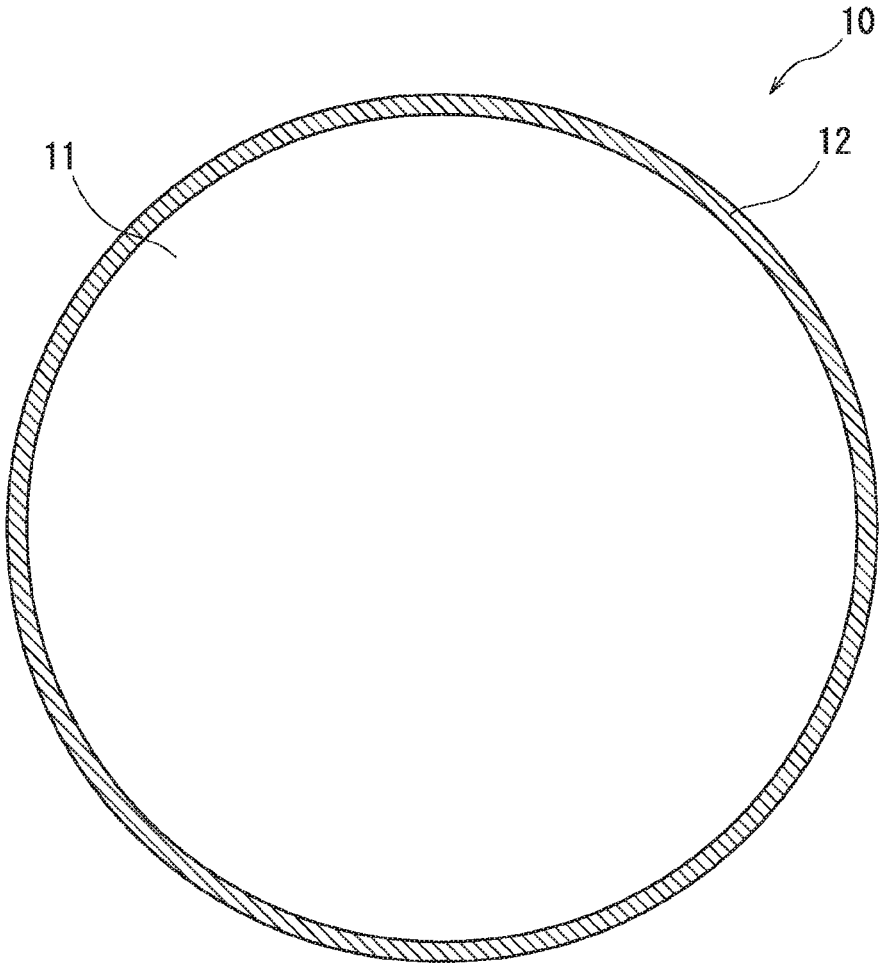
FIG. 1 illustrates an example configuration in cross section of a toner particle (specifically, a toner mother particle) included in an electrostatic latent image developing toner according to an embodiment of the present disclosure.

An embodiment of the present disclosure will be described in detail. Unless otherwise stated, evaluation results (for example, values indicating shape and physical properties) for a powder (specific examples include toner cores, toner mother particles, external additive, and toner) are number averages of values measured for a suitable number of particles that are selected as average particles within the powder.

Also, unless otherwise stated, the number average particle size of a powder is the diameter of a representative circle of a primary particle (i.e., the diameter of a circle having the same surface area as a projection of the particle) measured using a microscope. A measured value of a volume median diameter ($D_{50}$) of the powder is a value measured using Coulter Counter Multisizer 3 produced by Beckman Coulter, Inc. based on Coulter principle (electrical sensing zone method), unless otherwise stated.

Unless otherwise stated, charge strength corresponds to susceptibility to frictional charging. For example, when a toner is mixed with a standard carrier (anionic strength: N-01, cationic strength: P-01) provided by The Imaging Society of Japan and stirred, the toner can be frictionally charged. In a situation in which the surface potential of toner particles is measured using for example a Kelvin probe force microscopy (KFM) before and after being frictionally charged, a part of the toner particles where potential variation between before and after being frictionally charged is large is strongly charged.

In the present description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acrylic acid" is used as a generic term for both acrylic acid and methacrylic acid. Also, the term "(meth) acrylonitrile" is used as a generic term for both acrylonitrile and methacrylonitrile. In addition, the term "hydrophilic functional group" is used as a generic term for a functional group that can form a salt by ionization and a salt thereof. Examples of hydrophilic functional groups include acid groups (specific examples include a carboxyl group and a sulfo group) and hydroxyl groups or salts thereof (specific examples include —COONa, —$SO_3$Na, and —ONa). A subscript "n" for a repeating unit in a chemical formula indicates the number of repetitions (the number of moles) of the repeating unit. Unless otherwise stated, n (number of repetitions) is an arbitrary number.

A toner according to the present embodiment can be suitably used for development of an electrostatic latent image. The toner according to the present embodiment is a powder formed by a plurality of toner particles (particles each having features described later). The toner may be used as a one-component developer. Alternatively, the toner may be mixed with a carrier using a mixer (for example, ball mill) to prepare a two-component developer. In order to form a high-quality image, a ferrite carrier is preferably used as the carrier. In order to form a high-quality image durable for a long period of time, magnetic carrier particles are preferably used each of which includes a carrier core and a resin layer that cavers the carrier core. In a situation in which the magnetic carrier particles are produced, the carrier core may be formed by a magnetic material (for example, ferrite) or a resin in which the magnetic particles are dispersed. Alternatively, the magnetic particles may be dispersed in the resin layer covering the carrier core. In order to form a high-quality image, the amount of the toner contained in the two-component developer is preferably at least 5 parts by mass and no greater than 15 parts by mass relative to 100 parts by mass of the carrier, and more preferably at least 8 parts by mass and no greater than 12 parts by mass. A positively chargeable toner contained in a two-component developer is positively charged by friction with a carrier. A negatively chargeable toner contained in a two-component developer is negatively charged by friction with a carrier.

The toner particles included in the toner according to the present embodiment each include a core (hereinafter referred to as a toner core) and a shell layer (a capsule layer) disposed over the surface of the toner core. An external additive may be caused to adhere to the surfaces of the shell layers (or surface regions of the toner cores that are not covered with the shell layers). A plurality of shell layers may be formed in a layered manner on the surface of each toner cores. The external additive may be omitted in a situation in which such an external additive is not necessary. Toner particles before an external additive is caused to adhere thereto are referred to as toner mother particles. A material used for forming the toner cores is referred to as a toner core material. A material used for forming the shell layers is referred to as a shell material.

The toner according to the present embodiment can be used in for example an electrophotographic device (an image forming apparatus) for image formation. The following describes an example of a method by which an electrophotographic apparatus forms an image.

First, an electrostatic latent image is formed on a photosensitive member based on image data. Next, the formed electrostatic latent image is developed using a developer that includes a toner. In the development process, toner (for example, toner charged by friction with a carrier or a blade) on a development sleeve (for example a surface layer portion of a development roller of a developing device) disposed in the vicinity of the photosensitive member is caused to adhere to the electrostatic latent image such that a toner image is formed on the photosensitive member. In a subsequent transfer process, the toner image on the photosensitive member is transferred onto an intermediate transfer member (for example, a transfer belt) and thereafter the toner image on the intermediate transfer member is transferred onto a recording medium (for example, a sheet of paper). After transfer, the toner is heated in order to fix the toner to the recording medium. Through the method described above, an image is formed on the recording medium. A full-color image can for example be formed by superposing toner images of four different colors: black, yellow, magenta, and cyan.

The toner according to the present embodiment is an electrostatic latent image developing toner having the following features (hereinafter referred to as basic features).

(Basic Features of Toner)

The toner includes toner particles each including a toner core and a shell layer. The shell layer is substantially formed by a resin. The shell layer has a surface including a plurality of spot regions and a sheet region that is more hydrophobic than the spot regions. The spot regions each are more chargeable than the sheet region.

Figure 2:
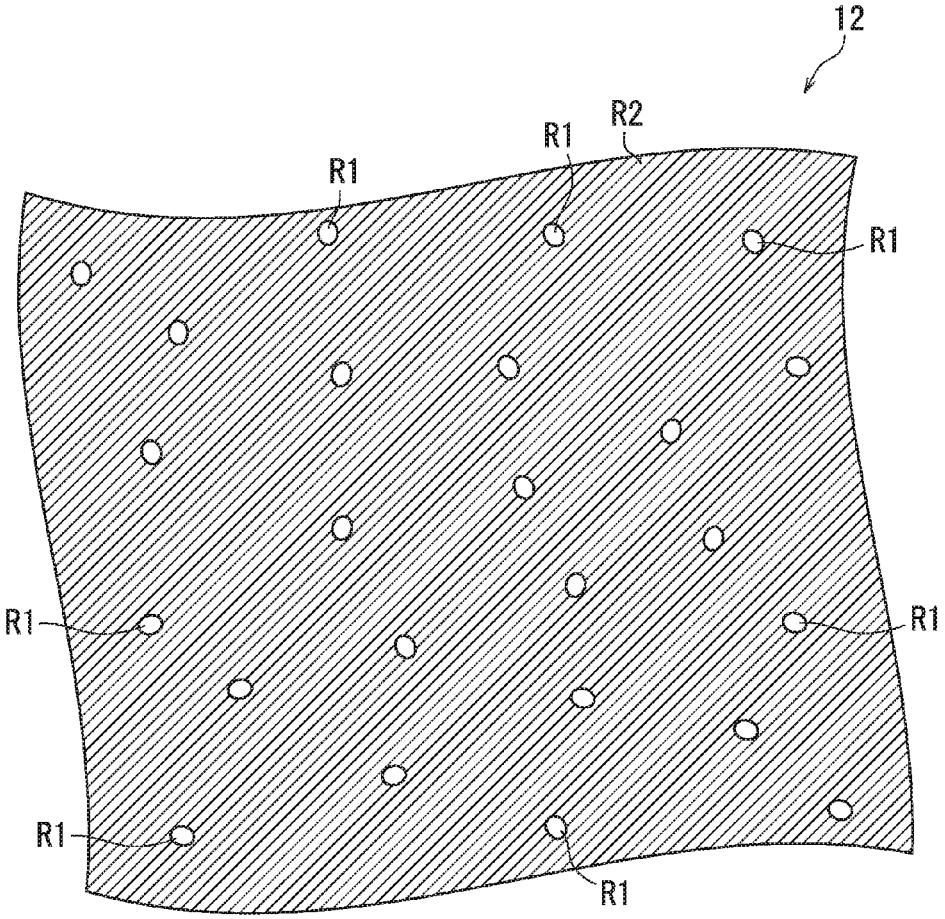
FIG. 2 is a diagram in an enlarged scale illustrating a portion of a surface of the toner mother particle in FIG. 1.
Figure 3A:
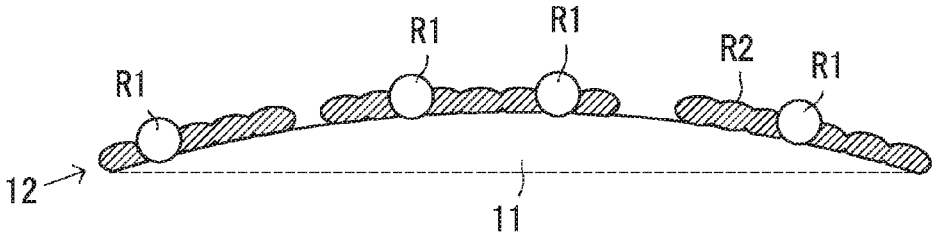
FIG. 3A illustrates a first example toner mother particle including resin particles that protrude from a surface of a resin film.
Figure 3B:
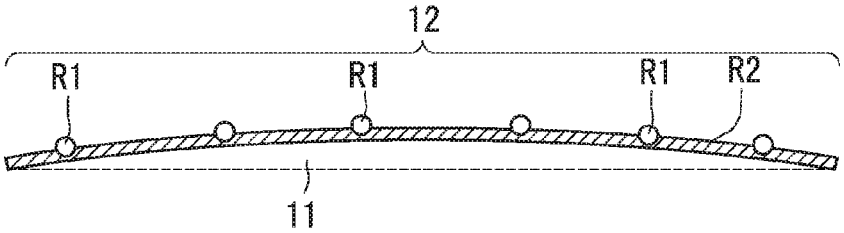
FIG. 3B illustrates of a second example toner mother particle including resin particles that protrude from a surface of a resin film.
Figure 3C:
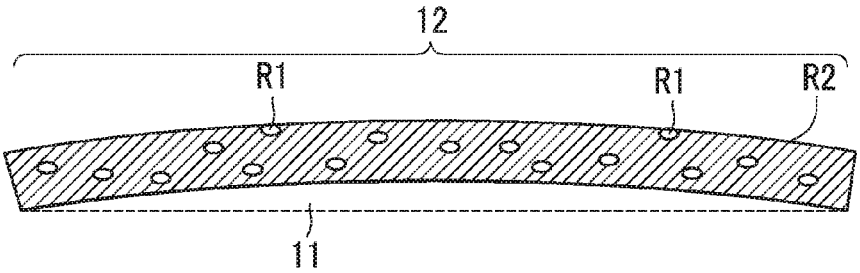
FIG. 3C illustrates an example toner mother particle including resin particles that do not protrude from a surface of a resin film.

Following describes an example configuration of the toner particles (specifically, toner mother particles) included in the toner according to the present embodiment with reference to FIGS. 1-3C. FIG. 1 illustrates an example configuration in cross section of a toner particle (specifically, a toner mother particle) included in the toner according to an embodiment. FIG. 2 illustrates in an enlarged scale a portion of a surface of the toner mother particle in FIG. 1. FIGS. 3A-3C each correspond to a diagram in an enlarged scale illustrating a boundary portion between a toner core 11 and a shell layer 12 in FIG. 1.

The toner mother particle 10 illustrated in FIG. 1 includes a toner core 11 and a shell layer 12 disposed over the surface of the toner core 11. The shell layer 12 is substantially formed by a resin. The shell layer 12 covers the surface of the toner core 11. The shell layer 12 may cover the entirety or a part of the surface of the toner core 11.

Furthermore, the shell layer 12 has a surface including a plurality of spot regions R1 and a sheet region R2, as illustrated in FIG. 2. The spot regions R1 each are more chargeable than the sheet region R2. The sheet region R2 is more hydrophobic than the spot regions R1. Only one sheet region R2 may be present. Alternatively, a plurality of sheet regions may be present. In the example illustrated in FIG. 2, the spot regions R1 are distributed on the surface of the shell layer 12. Further, the spot regions R1 and the sheet region R2 are arranged in a sea-and-island pattern (sea: sheet region R2, islands: spot regions R1). The spot regions R1 are surrounded by the sheet region R2.

In order that the toner has the basic features, the shell layer 12 preferably includes a resin film. More preferably, the resin film is formed such that a portion of the resin film exposed to the surface of the shell layer 12 corresponds to the sheet region R2. Specifically, when the resin film is substantially formed by a hydrophobic resin, the sheet region R2 is hydrophobic. The hatched regions in FIGS. 3A-3C each correspond to the resin film.

In order that the toner has the basic features, the shell layer 12 preferably includes a plurality of resin particles. More preferably, the resin particles are formed such that portions of the respective resin particles exposed to the surface of the shell layer 12 correspond to the spot regions R1. Specifically, formation of the resin particles by a resin containing a charge control agent (for example, thermoplastic resin having a repeating unit derived from a charge control agent) can provide chargeability to the spot regions R1. The resin particles are more frictionally chargeable than the resin film.

As illustrated in FIGS. 3A and 3B, the resin particles may protrude from the surface of the resin film. In the examples illustrated in FIGS. 3A and 3B, respective parts of the resin particles that protrude from the surface of the resin film correspond to the spot regions R1. In order that the resin particles protrude from the surface of the resin film, the resin film preferably has a thickness relatively smaller than the particle diameter of the resin particles. As illustrated in FIG. 3A, the resin particles may be in contact with the toner core 11. Alternatively, the resin particles may be out of contact with the toner core 11, as illustrated in FIG. 3B. In the examples illustrated in FIGS. 3A and 3B, the resin film functions as a bonding agent (specifically, a reactive bonding agent) to bond the resin particles to the toner core 11 through curing.

As illustrated in FIG. 3C, the resin particles may be distributed in the resin film. In the example illustrated in FIG. 3C, respective parts of the resin particles exposed to the surface of the resin film correspond to the spot regions R1.

In each example illustrated in FIGS. 3A-3C, the resin particles are each in contact with the resin film. The resin film may be a film having a granular appearance as illustrated in FIG. 3A or a film having no granular appearance as illustrated in FIGS. 3B and 3C. In a situation in which the resin particles are used as a material for forming a resin film, a resin film having no granular appearance is considered to be formed by curing the material (resin particles) that are completely melt into a film state. By contrast, a resin film including resin particles in a two-dimensionally continuous state (a resin film having granular appearance) is considered to be formed by curing the material (resin particles) that are incompletely melt into a film state. The resin particles included in the shell layer may have a spherical shape or an oval shape (a flat shape). Not necessarily all part of the resin film in the shell layer is formed integrally. The resin film in the shell layer may be a single film or an aggregate of a plurality of film fragments (islands) separate from one another.

The toner having the basic features is considered to be sufficiently chargeable in both an environment of normal temperature and normal humidity and an environment of high temperature and high humidity. Further, the toner having the basic features is considered to enable formation of a high-quality image (for example, an image having low fogging density) in both an environment of normal temperature and normal humidity and an environment of high temperature and high humidity. Specifically, in a configuration in which a plurality of spot regions that are comparatively strongly chargeable are present on the surfaces of the shell layers in the toner having the basic features, the toner can be sufficiently charged. Furthermore, in a configuration in which the sheet region that is more hydrophobic than the spot regions is present on the surface of each shell layer in the toner having the basic features, a situation in which the surfaces of the toner particles adsorb water molecules can be prevented in an environment of high temperature and high humidity. Decrease in charge amount of the toner particles is considered to be inhibited in an environment of high temperature and high humidity when the surfaces of the toner particles hardly adsorb water molecules. The use of a toner having sufficient chargeability can enable formation of a high-quality image (for example, an image having low fogging density).

In order that the toner is sufficiently charged in both an environment of normal temperature and normal humidity and an environment of high temperature and high humidity, the spot regions are preferably surrounded by the sheet region. In a configuration in which the sheet region that is strongly hydrophobic surrounds the spot regions that are weakly hydrophobic (comparatively strongly hydrophilic), adsorption of water molecules can be effectively prevented.

In order that the toner is sufficiently charged in both an environment of normal temperature and normal humidity and an environment of high temperature and high humidity, the spot regions are preferably distributed on the surfaces of the shell layers. Distribution of the spot regions without local collection can improve chargeability of the surfaces of the toner particles as a whole.

The toner according to the present embodiment includes a plurality of toner particles that are defined in the basic features (hereinafter referred to as toner particles in the present embodiment). The toner including the toner particles in the present embodiment is considered to be excellent in charge stability (see Tables 1 and 2 indicated later). Note that in order to improve charge stability of the toner, the toner preferably includes the toner particles in the present embodiment at a rate of 80% by number, more preferably 90% by number, and further more preferably 100% by number.

In order that the toner is sufficiently charged in both an environment of normal temperature and normal humidity and an environment of high temperature and high humidity, a ratio ($=S_B/S_A$) of a total area $S_B$ of each spot region relative to a total area $S_A$ of each sheet region on the surfaces of the shell layers is preferably at least 0.01 and no greater than 0.20, and more preferably at least 0.05 and no greater than 0.15.

In order that the toner is sufficient charged in both an environment of normal temperature and normal humidity and an environment of high temperature and high humidity in a situation in which the toner has a volume median diameter ($D_{50}$) of at least 3 μm and no greater than 10 μm, preferably a half or more (more preferably no less than 80% by number) of the spot regions have an equivalent circular diameter (a diameter of a circle having the same area of the area of a spot region) of at least 20 nm and no greater than 150 nm.

In order that the toner is sufficiently charged in both an environment of normal temperature and normal humidity and an environment of high temperature and high humidity, the toner having the basic features preferably has the following features (hereinafter referred to as a preferable shell features) in addition.

(Preferable Shell Features)

The shell layers each include a resin film and a plurality of resin particles. The resin film is substantially formed by a first resin. The resin particles are each substantially formed by a second resin. The first resin is more hydrophobic than the second resin. The second resin is more chargeable than the first resin. A part of the resin film exposed to the surface of each shell layer corresponds to the sheet region. Respective parts of the resin particles exposed to the resin film correspond to the spot regions.

In order that the toner having the preferable shell features is sufficiently charged in both an environment of normal temperature and normal humidity and an environment of high temperature and high humidity, a ratio ($=100\times M_B/M_A$) of a total mass $M_B$ of each resin contained in the resin particles relative to a total mass $M_A$ of each resin contained in the resin films is preferably at least 1% by mass and no greater than 20% by mass, and more preferably at least 5% by mass and no greater than 15% by mass.

In order to easily produce resin particles that are sufficiently positively chargeable, a resin forming the resin particles (second resin) is preferably a polymer of monomers including at least one vinyl compound containing no nitrogen and at least one nitrogen-containing vinyl compound. The vinyl compound is a compound having a vinyl group ($CH_2{=}CH{-}$) or a hydrogen-substituted vinyl group (specific examples include ethylene, propylene, vinyl chloride, acrylic acid, methyl acrylate, methacrylic acid, methyl methacrylate, acrylonitrile, and styrene). The vinyl compound is capable of becoming a macromolecule (resin) through addition polymerization by carbon double bond (C=C) of carbon contained in the vinyl group or the like.

In order that the resin particles of the shell layers in a positively chargeable toner are sufficiently positively charged, a resin forming the resin particles (second resin) preferably includes for example a repeating unit derived from a nitrogen-containing vinyl compound (for example, a quaternary ammonium compound), and more preferably a repeating unit expressed by the following chemical formula (1) or a salt thereof.

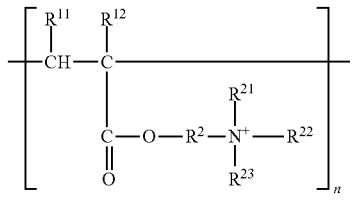

(1)

In the chemical formula (1), $R^{11}$ and $R^{12}$ each represent, independently of each other, a hydrogen atom, a halogen atom, or an optionally substituted alkyl group. Further, $R^{21}$, $R^{22}$, and $R^{23}$ each represent, independently of one another, a hydrogen atom, an optionally substituted alkyl group, or an optionally substituted alkoxy group. In addition, $R^2$ represents an optionally substituted alkylene group. Preferably, $R^{11}$ and $R^{12}$ each represent, independently of each other, a hydrogen atom or a methyl group. Particularly preferably, $R^{11}$ represents a hydrogen atom and $R^{12}$ represents a hydrogen atom or a methyl group. Furthermore, $R^{21}$, $R^{22}$, and $R^{23}$ preferably each represent, independently of one another, an alkyl group having a carbon number of 1-8, and particularly preferably a methyl group, an ethyl group, an n-propyl group, an iso-propyl group, an n-butyl group, or an iso-butyl group. Preferably, $R^2$ represents an alkylene group having a carbon number of 1-6, and particularly preferably a methylene group or an ethylene group. Note that in a repeating unit derived from [2-(methacryloyloxy)ethyl]trimethylammonium chloride, $R^{11}$, $R^{12}$ and $R^2$ respectively represent a hydrogen atom, a methyl group, and an ethylene group and $R^{21}$-$R^{23}$ each represent a methyl group such that of quaternary ammonium cations ($N^+$) ionically bond with chlorine (Cl) to forms a salt.

In order that the resin particles of the shell layers in a negatively chargeable toner are sufficiently negatively charged, a resin forming the resin particles (second resin) preferably includes a repeating unit having either or both a sulfo group (—$SO_3H$) and a salt thereof, and particularly preferably includes a repeating unit expressed by the following chemical formula (2).

(2)

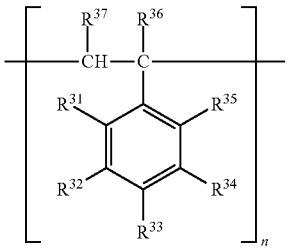

In the chemical formula (2), at least one of $R^{31}$-$R^{37}$ represents a sulfo group or a salt thereof and the other each represent, independently of each other, a hydrogen atom, a halogen atom, a hydroxyl group, an optionally substituted alkyl group, an optionally substituted alkoxy group, an optionally substituted alkoxy alkyl group, or an optionally substituted aryl group. Note that $R^{33}$ represents sodium salt (—$SO_3Na$) of a sulfo group and the others ($R^{31}$, $R^{32}$, and $R^{34}$-$R^{37}$) each represent a hydrogen atom in a repeating unit derived from p-sodium styrenesulfonate.

In order that the resin particles in the shell layers are sufficiently strongly charged and have appropriate strength, the resin forming the resin particles (second resin) preferably includes a repeating unit derived from a (meth)acrylic acid ester (specific examples include (meth)methyl acrylate, (meth)ethyl acrylate, (meth)propyl acrylate, and (meth)butyl acrylate), in addition to the repeating unit derived from a nitrogen-containing vinyl compound or the sulfo group (—$SO_3H$) or a salt thereof.

The resin forming the resin particles (second resin) in the shell layers may include a repeating unit having at least one of an acid group, a hydroxyl group, and salts thereof. The resin including such a repeating unit tends to be comparatively strongly hydrophilic. In a situation in which a toner has the "preferable shell feature", charge decay of the toner can be satisfactorily prevented even if the resin particles in the shell layers are comparatively strongly hydrophilic. The reason thereof is that the resin films (sheet regions) are more hydrophobic than the resin particles (spot regions).

The resin forming the resin films (first resin) in the shell layers preferably includes a repeating unit derived from for example a styrene-based monomer, and particularly preferably a repeating unit expressed by the following chemical formula (3).

(3)

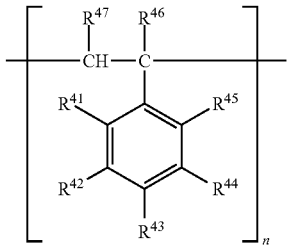

In the chemical formula (3), $R^{41}$-$R^{45}$ each represent, independently of each other, a hydrogen atom, a halogen atom, a hydroxyl group, an optionally substitute alkyl group, an optionally substitute alkoxy group, an optionally substituted alkoxy alkyl group, or an optionally substituted aryl group. Further, $R^{46}$ and $R^{47}$ each represent, independently of each other, a hydrogen atom, a halogen atom, or an optionally substituted alkyl group. Preferably, $R^{41}$-$R^{45}$ each represent, independently of one another, a hydrogen atom, a halogen atom, an alkyl group having a carbon number of 1-4, an alkoxy group having a carbon number of 1-4, or an alkoxy alkyl group having a carbon number (specifically, a total carbon number of alkoxy and alkyl) of 2-6. Preferably, $R^{46}$ and $R^{47}$ each represent, independently of each other, a hydrogen atom or a methyl group. A particularly preferable combination is $R^{47}$ representing a hydrogen atom and $R^{46}$ representing a hydrogen atom or a methyl group. Note that $R^{41}$-$R^{47}$ each represent a hydrogen atom in a repeating unit derived from styrene.

In order that the resin film in the shell layers is sufficiently strongly hydrophobic and has appropriate strength, the resin forming the resin films (first resin) is preferably a copolymer of at least one styrene-based monomer (more preferably at least one repeating unit expressed by the chemical formula (3)) and at least one acrylic acid-based monomer (specific examples include (meth)acrylonitrile, (meth)acrylic acid alkyl ester, and (meth)acrylic acid hydroxyalkyl ester).

In order that the resin films of the shell layers are sufficiently strongly hydrophobic and have appropriate strength, a repeating unit having the highest molar rate among repeating units included in the resin forming the resin films (first resin) is preferably a repeating unit derived from a styrene-based monomer (more preferably, a repeating unit expressed by the chemical formula (3)).

In order to satisfactorily prevent a situation in which moisture in the air is adsorbed to the surfaces of the resin films, a rate of a repeating unit including a hydrophilic functional group among all repeating units included in the resin forming the resin films (first resin) is preferably no greater than 10% by mass, and particularly preferably 0% by mass.

In order to improve both high-temperature preservability and low-temperature fixability of the toner, the resin films preferably have a thickness of at least 1 nm and no greater than 30 nm. The thickness of the resin films can be measured through analysis of a TEM image of a section of a toner particle using commercially available image analysis software (for example, WinROOF produced by Mitani Corporation). If the thickness of the resin film is not uniform for a single toner particle, the thickness of the resin film is measured at each of four locations that are evenly spaced and the arithmetic mean of the four measured values is determined to be an evaluation value (thickness of the resin film) for the toner particle. More specifically, the four measurement locations are determined by drawing two straight lines that intersect at right angles at approximately the center of the cross-section of the toner particle and by determining four locations at which the two straight lines and the shell layer intersect to be the measurement locations.

In order to improve both charge stability and high-temperature preservability of the toner having the preferable shell features, the shell layers preferably contain a thermosetting resin in addition. When the shell layers contain a thermosetting resin (for example, a hydrophilic thermosetting resin) in addition to inclusion of the resin film and the resin particles, strength of the shell layers can be improved. In order to improve both charge stability and high-temperature preservability of the toner, preferably at least 0.01% by mass and no greater than 50% by mass, and more preferably at least 0.01% by mass and no greater than 10% by mass of the thermosetting resin is contained in the shell layers among resins contained therein.

In order to improve both high-temperature preservability and low-temperature fixability of the toner, preferably the shell layers each cover at least 50% and no greater than 99%, and more preferably at least 70% and no greater than 95%, of a surface region of a toner core.

The toner cores (a binder resin and an internal additive), the shell layers, and the external additive will be described next in order. A component that is not necessary according to use of the toner may be omitted.

<Preferable Thermoplastic Resins>

Preferable examples of thermoplastic resins that can form the toner particles (particularly, the toner cores and the shell layers) include styrene-based resins, acrylic acid-based resins (specific example include a polymer of acrylic acid ester and a polymer of methacrylic acid ester), olefin-based resins (specific examples include polyethylene resin and polypropylene resin), vinyl resins (specific examples include a vinyl chloride resin, a polyvinyl alcohol, a vinyl ether resin, and an N-vinyl resin), polyester resins, polyamide resins, and urethane resins. Also, a copolymer of any of the resins, specifically a copolymer of any of the resins into which an optional repeating unit is introduced (specific examples include styrene-acryl acid-based resins and styrene-butadiene-based resins) can be preferably used.

The thermoplastic resin can be obtained through addition polymerization, copolymerization, or condensation polymerization of at least one of thermoplastic monomer. Note that the thermoplastic monomer is a monomer that is to become a thermoplastic resin through homopolymerization (specific examples include an acrylic acid-based monomer and a styrene-based monomer) or a monomer that is to become a thermoplastic resin through condensation polymerization (specific examples include an alcohol or a carboxylic acid that are to be a polyester resin through condensation polymerization).

A styrene-acrylic acid-based resin is a copolymer of at least one of styrene-based monomer and at least one of acrylic acid-based monomer. The below listed styrene-based monomers and acrylic acid-based monomers can be preferably used for synthesizing the styrene-acrylic acid-based resin. When an acrylic acid-based monomer having a carboxyl group is used, the carboxyl group can be introduced into the styrene-acrylic acid-based resin. Further, when a monomer having a hydroxyl group (specific examples include p-hydroxystyrene, m-hydroxystyrene, and (meth) acrylic acid hydroxyalkyl ester), the hydroxyl group can be introduced into the styrene-acrylic acid-based resin. When the amount of the acrylic acid-based monomer is adjusted, the acid value of the resultant styrene-acrylic acid-based resin can be adjusted. When the amount of a monomer having a hydroxyl group is adjusted, the hydroxyl value of the resultant styrene-acrylic acid-based resin can be adjusted.

Preferable examples of styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of acrylic acid-based monomers include (meth)acrylic acid, (meth)acrylonitrile, (meth) acrylic acid alkyl ester, and (meth)acrylic acid hydroxyalkyl ester. Preferable examples of (meth)acrylic acid alkyl esters include (meth)methyl acrylate, (meth)ethyl acrylate, (meth) n-propyl acrylate, (meth)isopropyl acrylate, (meth)n-butyl acrylate, (meth)isobutyl acrylate, and (meth)2-ethylhexyl acrylate. Preferable examples of (meth)acrylic acid hydroxyalkyl esters include (meth)acrylic acid 2-hydroxyethyl, (meth)acrylic acid 3-hydroxypropyl, (meth)acrylic acid 2-hydroxypropyl, and (meth)acrylic acid 4-hydroxybutyl.

A polyester resin can be prepared through condensation polymerization of at least one alcohol and at least one carboxylic acid. Examples of alcohols that can be preferably used for synthesizing the polyester resin include dihydric alcohols (specific examples include diols and bisphenols) and tri- or higher-hydric alcohols, as listed below. Examples of carboxylic acids that can be preferably used for synthesizing the polyester resin include dibasic carboxylic acids and tri- or higher-basic carboxylic acids, as listed below. When each amount of the alcohol and the carboxylic acid is changed in synthesis of the polyester resin, the acid value and the hydroxyl value of the polyester resin can be adjusted. The acid value and the hydroxyl value of the polyester resin tend to reduce by increasing the molecular weight of the polyester resin.

Preferable examples of diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols include bisphenol A, hydrogenated bisphenol A, bisphenol A ethylene oxide adduct, and bisphenol A propylene oxide adduct.

Preferable examples of tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, digylcerol, 2-methylpropanetriol, 2-methyl-1,2,4-butanetriol, trimethylolethane, trimethylolpropane, and 1,3,5-trihydroxymethylbenzene.

Preferable examples of dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acid (specific examples include n-butylsuccinic acid, isobutylsuccinic acid, n-octylsuccinic acid, n-dodecylsuccinic acid, and isododecylsuccinic acid), and alkenyl succinic acid (specific examples include n-butenylsuccinic acid, isobutenylsuccinic acid, n-octenylsuccinic acid, n-dodecenylsuccinic acid, and isododecenylsuccinic acid).

Preferable examples of tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Note that the di-, tri-, or higher-basic carboxylic acids may be deformed into ester-forming derivatives (specific examples include acid halide, acid anhydride, and lower alkyl ester). The term "lower alkyl" herein is defined as an alkyl group having a carbon number of 1-6.

<Preferable Thermosetting Resins>

Examples of thermosetting resins that can be preferably used to produce the toner particles (particularly, the shell layers) include melamine-based resins, urea-based resins, sulfonamide-based resins, glyoxal-based resins, guanamine-based resins, aniline-based resins, polyimide resins (specific examples include a maleimide polymer and a bismaleimide polymer), and xylene-based resins.

The thermosetting resin can be prepared through crosslinking (polymerization) of at least one of thermosetting monomer. When a crosslinking agent is used, the thermosetting resin can be synthesized by a thermosetting monomer. Note that the thermosetting monomer has a crosslinking property. For example, in a situation in which monomers of the same species are three-dimensionally linked via "—$CH_2$—" to become a thermosetting resin, the monomers and the "thermosetting monomers" are equivalent.

Preferable examples of thermosetting monomers include methylol melamine, melamine, methylol urea (for example, dimethylol dihydroxyethyleneurea), urea, benzoguanamine, acetoguanamine, and spiroguanamine.

[Toner Cores]

The toner cores contain a binder resin. Further, the toner cores may optionally contain an internal additive (for example, a colorant, a releasing agent, a charge control agent, and a magnetic powder).

(Binder Resin)

The binder resin generally constitutes a large proportion (for example, no less than 85% by mass) of components of the toner cores. Properties of the binder resin are therefore expected to have great influence on an overall property of the toner cores. For example, in a configuration in which the binder resin has an ester group, a hydroxyl group, an ether group, an acid group, or a methyl group, the toner cores are highly likely to be anionic. In a configuration in which the binder resin has an amino group or an amide group, the toner cores are highly likely to be cationic. In order that the binder resin is highly anionic, at least one of the hydroxyl value (measuring method: Japan Industrial Standard (JIS) K0070-1992) and the acid value (measuring method: Japan Industrial Standard (JIS) K0070-1992) of the binder resin is preferably at least 10 mg KOH/g and no greater than 20 mg KOH/g.

The binder resin preferably has at least one of an ester group, a hydroxyl group, an ether group, an acid group, and a methyl group, and more preferably has either or both of a hydroxyl group and a carboxyl group. A binder resin having such a functional group tends to chemically bond to the shell layers through a reaction. Such chemical bond results in strong binding between the toner cores and the shell layers. Furthermore, the binder resin preferably has an activated hydrogen-containing functional group in molecules thereof.

In order to improve fixability of the toner in high speed fixing, the binder resin preferably has a glass transition point (Tg) of at least 20° C. and no greater than 55° C. The method for measuring the glass transition point (Tg) is the same as that employed in examples described later or an alternative method thereof.

In order to improve fixability of the toner in high speed fixing, the binder resin preferably has a softening point (Tm) of no greater than 100° C., and more preferably no greater than 95° C. When the shell layers are formed on the surfaces of toner cores in an aqueous medium in a situation in which the binder resin has a softening point (Tm) of no greater than 100° C. (preferably, no greater than 95° C.), the toner cores tend to be partially softened during a curing reaction of the shell layers. The toner cores therefore tend to be rounded by surface tension. The method for measuring the softening point (Tm) is the same as that employed in the examples described later or an alternative method thereof. When a plurality of resins having different softening points (Tm) are used in combination, the softening point (Tm) of the binder resin can be adjusted.

A thermoplastic resin (specific examples include the above "preferable thermoplastic resins") is preferable as the binder resin of the toner cores. In order to improve dispersibility of a colorant in the toner cores, chargeability of the toner, and fixability of the toner to a recording medium, styrene-acrylic acid-based resin or polyester resin is particularly preferably used as the binder resin.

In order to improve strength of the toner cores and fixability of the toner in a situation in which a styrene-acrylic acid-based resin is used as the binder resin of the toner cores, the styrene-acrylic acid-based resin preferably has a number average molecular weight (Mn) of at least 2,000 and no greater than 3,000. The styrene-acrylic acid-based resin preferably has a molecular weight distribution (ratio Mw/Mn of a mass average molecular weight (Mw) relative to a number average molecular weight (Mn)) of at least 10 and no greater than 20. Gel permeation chromatography can be employed for measuring Mn and Mw of the styrene-acrylic acid-based resin.

In order to improve strength of the toner cores and fixability of the toner in a situation in which a polyester resin is used as the binder resin of the toner cores, the polyester resin preferably has a number average molecular weight (Mn) of at least 1,000 and no greater than 2,000. The polyester resin preferably has a molecular weight distribution (ratio Mw/Mn of a mass average molecular weight (Mw) relative to a number average molecular weight (Mn)) of at least 9 and no greater than 21. Gel permeation chromatography can be employed for measuring Mn and Mw of the polyester resin.

(Colorant)

The toner cores may optionally contain a colorant. The colorant can be a known pigment or dye that matches the color of the toner. The amount of the colorant is preferably at least 1 part by mass and no greater than 20 parts by mass relative to 100 parts by mass of the binder resin, and more preferably at least 3 parts by mass and no greater than 10 parts by mass in order to form a high-quality image with the toner.

The toner cores may contain a black colorant. Carbon black can be used as the black colorant. The black colorant may be a colorant that is adjusted to a black color using a yellow colorant, a magenta colorant, and a cyan colorant.

The toner cores may contain a non-black colorant such as a yellow colorant, a magenta colorant, or a cyan colorant.

Examples of yellow colorants that can be used include condensed azo compounds, isoindolinone compounds, anthraquinone compounds, azo metal complexes, methine compounds, and arylamide compounds. Specific examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

Examples of magenta colorants that can be used include of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of cyan colorants that can be used include copper phthalocyanine compounds, anthraquinone compounds, and basic dye lake compounds. Specific examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores may optionally contain a releasing agent. The releasing agent is for example used in order to improve fixability of the toner or resistance of the toner to being offset. In order to improve anionic strength of the toner cores, the toner cores are preferably prepared using an anionic wax. In order to improve fixability of the toner or offset resistance, the amount of the releasing agent is preferably at least 1 part by mass and no greater than 30 parts by mass relative to 100 parts by mass of the binder resin, and more preferably at least 5 parts by mass and no greater than 20 parts by mass.

Examples of releasing agents that can be preferably used include aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax. A single type of releasing agent may be used or a combination of a plurality of types of releasing agent may be used.

A compatibilizer may optionally be added to the toner cores in order to improve compatibility between the binder resin and the releasing agent.

(Charge Control Agent)

The toner cores may optionally contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased through the toner cores containing a negatively chargeable charge control agent. The cationic strength of the toner cores can be increased through the toner cores containing a positively chargeable charge control agent. However, if sufficient chargeability is secured in the toner, there is no need to use a charge control age.

(Magnetic Powder)

The toner cores may optionally contain a magnetic powder. Examples of materials of the magnetic powder that can be preferably used include ferromagnetic metals (specific examples include iron, cobalt, and nickel), alloys of such ferromagnetic metals, ferromagnetic metal oxides (specific examples include ferrite, magnetite, and chromium dioxide), and materials subjected to ferromagnetization (specific examples include thermal treatment). A single type of magnetic powder may be used or a combination of a plurality of types of magnetic powder may be used.

The magnetic powder is preferably subjected to surface treatment in order to inhibit elution of metal ions (for example, iron ions) from the magnetic powder. In a situation in which shell layers are formed on the surfaces of toner cores under acidic conditions, elution of metal ions to the surfaces of the toner cores causes the toner cores to adhere to one another more readily. Adhesion of the toner cores to one another can be inhibited by inhibiting elution of metal ions from the magnetic powder.

[Shell Layers]

In the "preferable shell features", the shell layers each include a resin film and a plurality of resin particles. Further, the shell layers may optionally contain a thermosetting resin (specific examples include the "preferable thermosetting resins" described above) in addition to inclusion of the resin film and the resin particles. In order to improve charge stability and high-temperature preservability of the toner, the shell layers preferably contain at least one of melamine-based resins, urea-based resins, and glyoxal-based resins as the thermosetting resin.

(Resin Film)

In the "preferable shell features", the resin substantially forming the resin films (first resin) is preferably a thermoplastic resin (specific examples include the "preferable thermoplastic resins" described above), and particularly preferably a copolymer of at least one of styrene-based monomer and at least one of acrylic acid-based monomer. Styrene-acrylic acid-based resins are more hydrophobic and more positively chargeable than polyester resins. Preferable examples of the resin forming the resin films (first resin) include a copolymer of styrene and (meth)butyl acrylate; a copolymer of styrene, (meth)butyl acrylate, and (meth) acrylic acid hydroxyalkyl ester; and a copolymer of styrene, (meth)butyl acrylate, and acrylonitrile.

(Resin Particles)

In the "preferable shell features", the resin substantially forming the resin particles (second resin) is preferably thermoplastic resin into which a repeating unit derived from a charge control agent (hereinafter referred to as a chargeable unit) is introduced (specific examples include the "preferable thermoplastic resins" described above). The charge control agent for introducing the chargeable unit into the resin is preferably a radically-polymerizable monomer.

Preferable examples of thermoplastic resins into which a chargeable unit is introduced include acrylic acid-based resins (a specific example is a copolymer of methyl methacrylate and butyl acrylate) and styrene-acrylic acid-based resins (specific examples include a copolymer of styrene, methyl methacrylate, and butyl acrylate).

Following lists preferable examples of charge control agents for introducing a chargeable unit into the resin. Note that a derivative of any of the following compounds may be used as necessary.

Examples of positively chargeable charge control agents that can be preferably used include compounds having a primary amino group, a secondary amino group, a tertiary amino group, or a quaternary ammonium group.

Examples of negatively chargeable charge control agents that can be preferably used include sulfonic acid compounds, phosphorous acid compounds, and carboxylic acid compounds.

Particularly preferable examples of charge control agents for introducing a chargeable unit into the resin include styrene sulfonic acid, sodium styrenesulfonate, 2-acrylamido-2-methylpropane sulfonate, 2-acid-phosphooxypropyl methacrylate, 2-acid-phosphooxyethyl methacrylate, 3-chloro-2-acid-phosphooxypropyl methacrylate, acrylic acid, methacrylic acid, fumaric acid, crotonic acid, tetrahydrophthalic anhydride, itaconic acid, aminostyrene, aminoethyl methacrylate, aminopropyl acrylate, diethyl aminopropyl acrylate, γ-N—(N',N'-diethyl aminoethyl)aminopropyl methacrylate, and trimethylammonium propyl methacrylate.

[External Additive]

An external additive may optionally be caused to adhere to the surfaces of the toner mother particles. For example, when the external additive is stirred together with the toner mother particles, the external additive is caused to adhere (physically bond) to the surfaces of the toner mother particles by physical force. The external additive may be used for example in order to improve fluidity or handling property of the toner. The amount of the external additive is preferably at least 0.5 parts by mass and no greater than 10 parts by mass relative to 100 parts by mass of the toner mother particles in order to improve fluidity or handling property of the toner. In order to improve fluidity or handling property of the toner, the external additive preferably has a particle size of at least 0.01 μm and no greater than 1.0 μm.

Inorganic particles are preferable as the external additive. Particles of silica or a metal oxide (specific examples of metal oxides include alumina, titanium oxide, magnesium oxide, zinc oxide, strontium titanate, and barium titanate) are particularly preferable. However, resin particles may be used as the external additive. A single type of external additive may be used or a combination of a plurality of types of external additives may be used.

[Toner Manufacturing Method]

Following describes an example of the method for manufacturing a toner having the features according to the present embodiment. Toner cores and a shell material are added into a liquid. Subsequently, the shell material attached to the surfaces of the toner cores is caused to react in the liquid to form shell layers substantially formed by resin.

In order to form homogenous shell layers, preferably a liquid containing the shell material is for example stirred so that the shell material is dissolved or dispersed in the liquid. In order to inhibit the toner core components (particularly, a binder resin and a releasing agent) from being dissolved or eluted in shell layer formation, the shell layers are preferably formed in an aqueous medium. The aqueous medium is a medium of which main component is water (specific examples include pure water and a mixed liquid of water and a polar medium). The aqueous medium may function as a solvent. A solute may be dissolved in the aqueous medium. The aqueous medium may function as a dispersion medium. A dispersoid may be dispersed in the aqueous medium. For example, an alcohol (specific examples include methanol and ethanol) may be used as the polar medium in the aqueous medium.

The method for manufacturing the toner according to the present embodiment will be further described below based on a more specific example.

(Toner Core Production Process)

Examples of preferable toner core production processes include an aggregation method and a pulverization method. The pulverization method is more preferable for toner core production.

An example pulverization method will be described below. First, a binder resin and an internal additive (for example, at least one of a colorant, a releasing agent, a charge control agent, and a magnetic powder) are mixed. The resultant mixture is then melted and kneaded. Next, the resultant melt-kneaded substance is pulverized and then classified. Through the above, toner cores having a desired particle size are produced.

An example aggregation method will be described below. First, binder resin fine particles, releasing agent fine particles, and colorant fine particles are caused to aggregate in an aqueous medium to form aggregated particles containing components of the binder resin, the releasing agent, and the colorant. Subsequently, the resultant aggregated particles are heated to cause coalescence of the components contained in the aggregated particles. As a result, a dispersion of toner cores is obtained. Thereafter, unnecessary substances (surfactant and the like) are removed from the dispersion of the toner cores to produce the toner cores.

(Shell Layer Formation Process)

For example, ion exchanged water is prepared as the liquid into which the toner cores and the shell material are added. Subsequently, the pH of the liquid is adjusted to a predetermined pH using for example hydrochloric acid. The pH of the liquid is preferably adjusted to at least 3 and no greater than 5 (to be weakly acid) in order to promote shell layer formation.

Subsequently, the toner cores, a suspension of first resin particles (a material of resin films constituting the shell layers), and a suspension of second resin particles (a material of resin particles constituting the shell layers) are added to the liquid after pH adjustment (for example, an acidic aqueous medium). The second resin particles are more chargeable than the first resin particles. The first resin particles are more hydrophobic than the second resin particles. The additive amount of the second resin particles is preferably controlled to an appropriate amount in order to form the spot regions mentioned in the basic features. In a situation in which the additive amount of the second resin particles, which tend to adsorb water molecules, is too large, charge retentivity of the toner may decrease in an environment of high temperature and high humidity. As a result, chargeability of the toner may tend to be insufficient. In a situation in which the additive amount of the second resin particles is too large, spot regions that are strongly chargeable may not be formed on the surfaces of the shell layers. In order that the toner has the basic features, the glass transition point (Tg) of the second resin particles is preferably at least 5° C. greater than that of the first resin particles. The method for measuring the glass transition point (Tg) is the same as that employed in the examples described later or an alternative method thereof. A material for synthesizing a thermosetting resin (for example, a thermosetting monomer) may be added to the liquid as necessary.

The shell material and the like may be added to the liquid at room temperature. Note that management of liquid temperature can result in molecular weight control of the shell layers. An appropriate additive amount of the shell material can be calculated based on the specific surface area of the toner cores. A polymerization accelerator may be optionally added to the liquid in addition to the shell material and the like.

Figure 4:
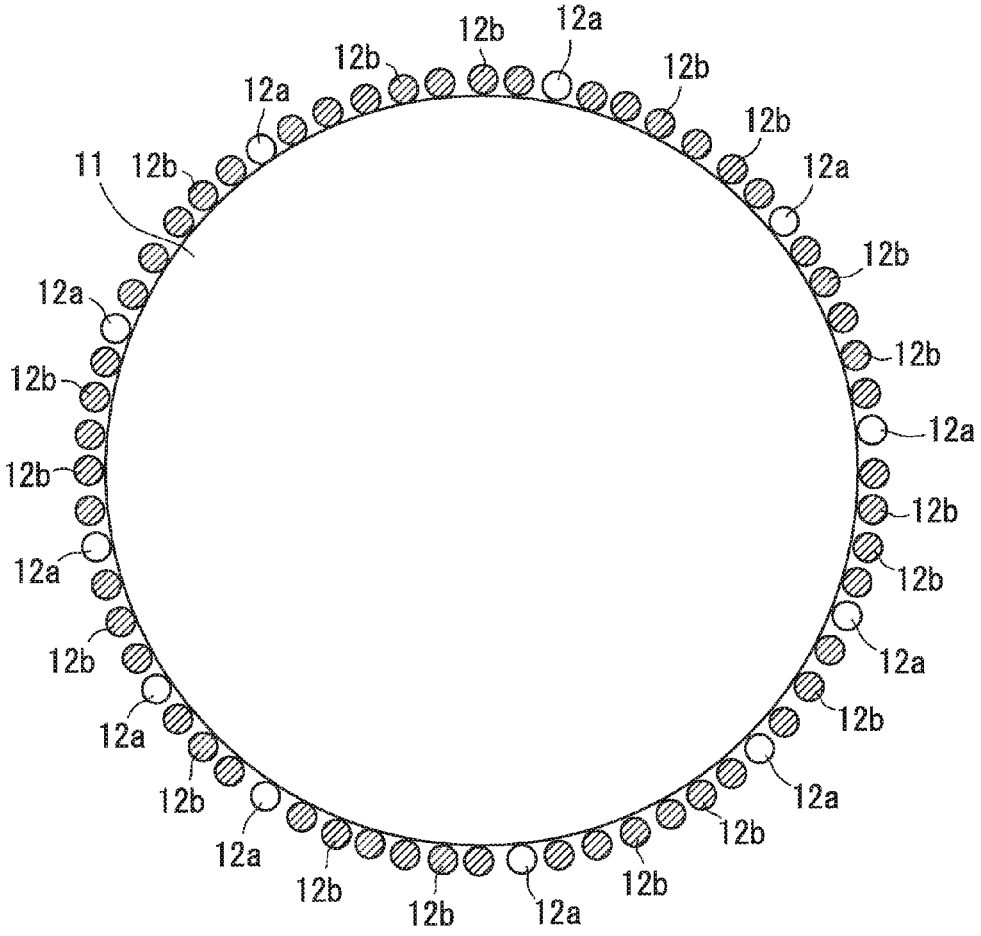
FIG. 4 is a diagram explaining a method for manufacturing the electrostatic latent image developing toner according to an embodiment of the present disclosure.

As illustrated in FIG. 4, second resin particles 12*a* and first resin particles 12*b* are attached to the surface of the toner core 11 in the liquid. Preferably, the toner cores are highly dispersed in the liquid containing the shell material in order to uniformly attach the shell material to surfaces of the toner cores. In order to highly disperse the toner cores in the liquid, the liquid may contain a dispersant or be stirred using a stirring device having strong power (for example, Hivis Disper Mix produced by PRIMIX Corporation).

Subsequently, while being stirred, the liquid containing the shell material and the like is increased in temperature up to a predetermined retention temperature (for example, a temperature of at least 50° C. and no greater than 85° C.) at a predetermined rate (for example, a rate of at least 0.1° C./min and no greater than 3° C./min.). The temperature of the liquid is then maintained at the retention temperature for a predetermined time period (for example, at least 30 minutes and no greater than 4 hours) while the liquid is stirred. A reaction between the toner cores and the shell material (solidification of the shell layers) is considered to proceed during the liquid being maintained at high temperature. The shell material bonds to the toner cores to form the shell layers. The second resin particles are considered to be directly solidified in the form of particles on the surfaces of the toner cores. The first resin particles are considered to be melt in the liquid and hardened in the form of a film. When the resin film that forms a shell layer is hardened, the toner cores and the shell layer (the resin film and the resin particles) are integrated. The shell layer formed on the surface of each toner core includes a resin film (sea region) and resin particles (island regions) distributed in an island state on the resin film (sea region). When the shell layers are formed on the surfaces of the toner cores in the liquid, a dispersion in which toner mother particles are dispersed is prepared.

When the first resin particles are attached to the surfaces of the toner cores in the liquid and the liquid is heated as described above, the first resin particles can be melt into a film shape. However, the first resin particles may be caused to be in a film shape by heating in a drying process or receiving physical impact force in an external addition process.

In order to inhibit elution of the toner core components or deformation of the toner cores, the retention temperature is preferably below the glass transition point (Tg) of the toner cores. However, the toner cores may be forcedly deformed by setting the retention temperature to be at least the glass transition point (Tg) of the toner cores. High retention temperature can promote deformation of the toner cores. As a result, the shape of the toner mother particles tends to approximate to a true sphere. It is desirable to adjust the retention temperature so that the toner mother particles have a desired shape. When the shell material is caused to react at high temperature, the sell layers tend to be hard. The molecular weight of the shell layers can be controlled by controlling the retention temperature.

After shell layer formation as above, the dispersion of the toner mother particles are neutralized using for example sodium hydroxide. The dispersion of the toner mother particles is then cooled to for example normal temperature (approximately 25° C.). Subsequently, the dispersion of the toner mother particles is filtrated using for example a Buchner funnel. Through the above, the toner mother particles are separated (solid-liquid separated) from the liquid to collect a wet cake of the toner mother particles. The collected wet cake of the toner mother particles was then washed. Subsequently, the washed toner mother particles are dried. Thereafter, as necessary, the toner mother particles and an external additive may be mixed using a mixer (for example, an FM mixer produced by Nippon Coke & Engineering Co., Ltd.) to cause the external additive to adhere to the surfaces of the toner mother particles. In a situation in which a spray dryer is used in the drying process, the drying process and the external addition process can be carried out simultaneously by spraying a dispersion of an external additive, such as silica particles, toward the toner mother particles. Through the above, a toner including a large number of toner particles is manufactured.

The contents and the order of the processes in the toner manufacturing method described above may be altered as appropriate in accordance with requirements of the toner, such as in terms of composition and properties. For example, the pH adjustment of the liquid (for example, an aqueous medium) may be carried out before or after the shell material and the like (the shell material and the toner cores) are added to the liquid. The shell material and the like may be added altogether at one time or separately. Further, the liquid may be heated up to the retention temperature before addition of the shell material and the like to the liquid. In a situation in which a material (for example, the shell material) is caused to react in the liquid, the material may be caused to react in the liquid for a predetermined time period after the material is added to the liquid. Alternatively, the material may be caused to react in the liquid while being added to the liquid over time. The shell material may be added to the liquid at one time or in plural times. The shell layers may be formed based on any method. For example, the shell layers may be formed based on an in-situ polymerization method, a coacervation method, or a film formation method by curing in a liquid. Toner may be sifted after the external addition process. Non-essential processes may alternatively be omitted. In a situation in which an external additive is not caused to adhere to the surfaces of the toner mother particles (i.e., the external addition step is omitted), the toner mother particles and the toner particles are equivalent. The toner core material and the shell material are not limited to the respective compounds described above (specific examples include monomers for synthesizing a resin). For example, a derivative of any of the above compounds may be used as the toner core material or the shell material as necessary. Alternatively, a prepolymer may be used instead of the monomer. The respective materials may be used in a solid state or a liquid state. For example, a powdery material in a solid state may be used. Alternatively, a solution of a material (the material in a liquid state dissolved in a solvent) may be used or a dispersion of a material (a liquid in which the material in a solid state is dispersed) may be used. In order to efficiently manufacture the toner, preferably a large number of toner particles are produced at the same time. The toner particles produced at the same time are considered to have substantially the same configuration.

Example

Following describes examples of the present embodiment. Table 1 indicates toners A-I (electrostatic latent image developing toners) according to examples and comparative examples.

TABLE 1

| | First resin | | Second resin | | Thermosetting resin |
|---|---|---|---|---|---|
| Toner | Type | Amount [g] | Type | Amount [g] | Amount [g] |
| A | A-1 | 220 | B-1 | 1.2 | 0.35 |
| B | A-1 | 220 | B-1 | 0.4 | 0.35 |
| C | A-1 | 220 | B-1 | 2.0 | 0.35 |
| D | A-1 | 220 | B-2 | 1.2 | 0.35 |
| E | A-1 | 220 | B-1 | 1.2 | — |
| F | A-2 | 220 | — | — | 0.35 |
| G | A-1 | 220 | — | — | 0.35 |
| H | A-1 | 220 | B-1 | 4.0 | 0.35 |
| I | A-1 | 220 | B-3 | 1.2 | — |

The following sequentially describes manufacturing methods of the respective toners A-I according to the examples and the comparative examples (electrostatic latent image developing toners), an evaluation method, and evaluation results. In evaluations in which errors may occur, an evaluation value was calculated by calculating the arithmetic mean of an appropriate number of measured values in order to ensure that any errors were sufficiently small. The number average particle sizes were measured using a transmission electron microscope (TEM). Respective methods of measuring a glass transition point (Tg) and a softening point (Tm) are as follows unless otherwise stated.

<Glass Transition Point (Tg) Measuring Method>

A heat absorption curve of a sample (for example, a resin) was plotted using a differential scanning calorimeter (DSC-6220 produced by Seiko Instruments Inc.). Subsequently, the glass transition point (Tg) of the sample was read from the plotted heat absorption curve. The glass transition point (Tg) of the sample is a temperature on the plotted heat absorption curve corresponding to a point of variation of the specific heat (an intersection point of an extrapolated baseline and an extrapolated fall line).

<Softening Point (Tm) Measuring Method>

An S-shaped curve (horizontal axis: temperature, vertical axis: stroke) of a sample (for example, a resin) was plotted by placing the sample in a capillary rheometer (CFT-500D produced by Shimadzu Corporation) and causing melt-flow of 1 $cm^3$ of a sample under conditions of a die pore diameter of 1 mm, a plunger load of 20 $kg/cm^2$, and a heating rate of 6° C./min. Subsequently, the softening point (Tm) of the sample was read from the plotted S-shaped curve. The softening point (Tm) of the sample is a temperature on the plotted S-shaped curve corresponding to a stroke value of $(S_1+S_2)/2$, where $S_1$ represents a maximum stroke value and $S_2$ represents a baseline stroke value at low temperatures.

[Method for Manufacturing Toner A]

(Toner Core Production Process)

An FM mixer produced by Nippon Coke & Engineering Co., Ltd. was used to mix 750 g of a low-viscosity polyester resin (Tg=38° C., Tm=65° C.), 100 g of an intermediate-viscosity polyester resin (Tg=53° C., Tm=84° C.), 150 g of a high-viscosity polyester resin (Tg=71° C., Tm=120° C.), 55 g of a carnauba wax (Carnauba Wax No. 1 produced by S. KATO & CO.), and 40 g of a colorant (phthalocyanine blue, KET BLUE 111 produced by DIC Corporation) at a rotational speed of 2,400 rpm.

Subsequently, the resultant mixture was melt-knead using a two-screw extruder (PCM-30 produced by Ikegai Corp.) under conditions of a material input rate of 5 kg/hour, a shaft rotational speed of 160 rpm, and a temperature setting range (cylinder temperature) of 100° C. to 130° C. The resultant melt-knead product was cooled then and the cooled melt-knead produce was coarsely pulverized using a pulverizer (Rotoplex (registered Japanese trademark) produced by Hosokawa Micron Corporation). Next, the coarsely pulverized product was finely pulverized using a jet mill (Supersonic Jet Mill I produced by Nippon Pneumatic Mfg. Co., Ltd.). The finely pulverized product was then classified using a classifier (Elbow Jet EJ-LABO produced by Nittetsu Mining Co., Ltd.). Through the above, toner cores having a volume median diameter ($D_{50}$) of 6 μm were produced.

(Preparation of First Shell Material)

A 1-L three-necked flask equipped with a thermometer and a stirring impeller was set in a water bath. Then, 875 mL of ion exchanged water and 75 mL of an anionic surfactant (LATEMUL (registered Japanese trademark) WX produced by Kao Corporation, component: sodium polyoxyethylene alkyl ether sulfate, solid concentration: 26% by mass) were added into the flask. Subsequently, the internal temperature of the flask was increased to 80° C. using a water bath and then maintained at the temperature (80° C.). Next, two liquids (a first liquid and a second liquid) were dripped into the flask at a temperature of 80° C. over 5 hours. The first liquid was a mixed liquid of 18 g of styrene and 2 g of butyl acrylate. The second liquid was a solution of 0.5 g of potassium persulfate dissolved in 30 mL of ion exchanged water. The internal temperature of the flask is then maintained at 80° C. for additional 2 hours for polymerization of the flask contents. As a result, a suspension (hereinafter referred to as a suspension A-1) of resin particulates (hydrophobic resin) was prepared. The resin particulates contained in the prepared suspension A-1 had a number average particle size of 32 nm and a glass transition point (Tg) of 71° C.

(Preparation of Second Shell Material)

Into a 1-L three-necked flask equipped with a thermometer, a cooling tube, a nitrogen inlet tube, and a stirring impeller, 90 mL of isobutanol, 100 g of methyl methacrylate, 35 g of butyl acrylate, 30 g of [2-(methacryloyloxy)ethyl] trimethylammonium chloride (product of Alfa Aesar), and 6 mL of 2,2'-azobis[2-methyl-N-(2-hydroxyethyl)propionamide] (VA-086 produced by Wako Pure Chemical Industries, Ltd.) were added. Subsequently, the flask contents were allowed to react for 3 hours in a nitrogen atmosphere at a temperature of 80° C. Thereafter, 3 mL of 2,2'-azobis [2-methyl-N-(2-hydroxyethyl)propionamide] (VA-086 produced by Wako Pure Chemical Industries, Ltd.) was added into the flask and the flask contents were allowed to react for additional 3 hours in a nitrogen atmosphere at a temperature of 80° C. As a result, a liquid containing a polymer was prepared. The resultant liquid containing the polymer was then dried in a reduced pressure atmosphere at a temperature of 150° C. Subsequently, the dried polymer was broken to produce a positively chargeable resin.

Next, 200 g of the positively chargeable resin produced as above and 184 mL of ethyl acetate (ethyl acetate JIS special grade produced by Wako Pure Chemical Industries, Ltd.) were added into a container of a mixer (HIVIS MIX 2P-1 produced by PRIMIX Corporation). The container contents were then stirred at a rotational speed of 20 rpm for 1 hour to prepare a high-viscosity solution. Thereafter, an aqueous solution of ethyl acetate and the like was added to the resultant high-viscosity solution. Specifically, the aqueous solution was 18 mL of 1N-hydrochloric acid, 20 g of anionic surfactant (Emal 0 produced by Kao Corporation, component: sodium lauryl sulfate), and 16 g of ethyl acetate (ethyl acetate JIS special grade produced by Wako Pure Chemical Industries, Ltd.) that were dissolved in 562 mL of ion exchanged water. Through the above, a suspension (hereinafter referred to as a suspension B-1) of a positively chargeable resin particulates (resin containing a charge control agent) was prepared. The resin particulates contained in the resultant suspension B-1 had a number average particle size of 35 nm and a glass transition point (Tg) of 80° C.

(Shell Layer Formation Process)

A 1-L three-necked flask equipped with a thermometer and a stirring impeller was set in a water bath, and 100 mL of ion exchanged water was added into the flask. Subsequently, the internal temperature of the flask was maintained at 30° C. using the water bath. Then, dilute hydrochloric acid was added into the flask to adjust the pH of the flask contents to 4. Next, 0.35 g of an aqueous solution of a hexamethylol melamine prepolymer (MIRBANE (registered Japanese trademark) RESIN SM-607 produced by Showa Denko K.K., solid concentration: 80% by mass), 220 g of the suspension A-1 (solid concentration: 2% by mass), and 1.2 g of the suspension B-1 (solid concentration: 20% by mass) were added into the flask.

Thereafter, 300 g of toner cores prepared through the above process were added into the flask and the flask contents were stirred at a rotational speed of 200 rpm for 1 hour. Then, 300 mL of ion exchanged water was added into the flask. Next, the internal temperature of the flask was increased to 70° C. at a rate of 1° C./min while the flask contents were stirred at a rotational speed of 100 rpm. The flask contents were then stirred for 2 hours under conditions of a temperature of 70° C. and a rotational speed of 100 rpm.

Subsequently, sodium hydroxide was added into the flask to adjust the pH of the flask contents to 7. The flask contents were then cooled to the normal temperature (approximately 25° C.). As a result, a toner mother particle-containing dispersion was prepared.

(Washing Process)

A wet cake of the toner mother particles was collected from the resultant dispersion of the toner mother particles by filtration (solid-liquid separation) using a Buchner funnel. Thereafter, the collected wet cake of the toner mother particles was re-dispersed in ion exchanged water. Further, dispersion and filtration were repeated five times for washing the toner mother particles.

(Drying Process)

Subsequently, the resultant toner mother particles were dispersed in an aqueous solution of ethanol at a concentration of 50% by mass. As a result, a slurry of the toner mother particles was prepared. Next, the prepared slurry was then fed into a continuous type surface modifier (Coatmizer (registered Japanese trademark) produced by Freund Corporation) to dry the toner mother particles in the slurry under conditions of a hot air temperature of 45° C. and a blower air flow rate of 2 $m^3$/min. As a result, a powder of dry toner mother particles was yielded. The dry toner mother particles were observed using a scanning electron microscope (SEM) to find that the shell layers were granular and particles that form the shell layers were not separate from one another.

(External Addition Process)

Subsequently, the resultant toner mother particles were subjected to external addition. Specifically, a 10-L FM mixer (a product of Nippon Coke & Engineering Co., Ltd.) was used to mix 100 parts by mass of the toner mother particles resulting from the drying step and 1.0 parts by mass of dry silica particulates (AEROSIL (registered Japanese trademark) REA 90 produced by Nippon Aerosil Co., Ltd.) for 5 minutes to cause an external additive (silica particles) to adhere to the surfaces of the toner mother particles. Thereafter, the resultant toner was sifted using a 200 mesh (opening 75 μm) sieve to yield a toner A including a large number of toner particles.

[Method for Manufacturing Toner B]

The toner B was manufactured according to the same method as the toner A in all aspects other than that the amount of the suspension B-1 was changed from 1.2 g to 0.4 g in the shell layer formation process.

[Method for Manufacturing Toner C]

The toner C was manufactured according to the same method as the toner A in all aspects other than that the amount of the suspension B-1 was changed from 1.2 g to 2.0 g in the shell layer formation process.

[Method for Manufacturing Toner D]

The toner D was manufactured according to the same method as the toner A in all aspects other than that 1.2 g of the suspension B-2 (solid concentration: 20% by mass) was used instead of 1.2 g of the suspension B-1 in the shell layer formation process. The suspension B-2 was prepared according to the same method as the suspension B-1 in all aspects other than that an aqueous solution of 6 g of 1N-hydrochloric acid, 20 g of an anionic surfactant (Emal 0 produced by Kao Corporation, component: sodium lauryl sulfate), and 16 g of ethyl acetate (ethyl acetate JIS special grade produced by Wako Pure Chemical Industries, Ltd.) that were dissolved in 574 g of ion exchanged water was used as the aqueous solution of ethyl acetate and the like instead of an aqueous solution of 18 g of 1N-hydrochloric acid, 20 g of an anionic surfactant (Emal 0 produced by Kao Corporation, component: sodium lauryl sulfate), and 16 g of ethyl acetate (ethyl acetate JIS special grade produced by Wako Pure Chemical Industries, Ltd.) that were dissolved in 562 g of ion exchanged water. The resin particulates contained in the resultant suspension B-2 had a number average particle size of 46 nm and a glass transition point (Tg) of 81° C.

[Method for Manufacturing Toner E]

The toner E was manufactured according to the same method as the toner A in all aspects other than that the aqueous solution of a hexamethylol melamine prepolymer (MIRBANE RESIN SM-607) was not used in the shell layer formation process.

[Method for Manufacturing Toner F]

The toner F was manufactured according to the same method as the toner A in all aspects other than that 220 g of the suspension A-2 (solid concentration: 2% by mass) was used instead of 220 g of the suspension A-1 and the suspension B-1 was not used. The suspension A-2 was prepared according to the same method as the suspension A-1 in all aspects other than that a mixed liquid of 18 g of styrene, 2 g of butyl acrylate, and 0.2 g of [2-(methacryloyloxy)ethyl]trimethylammonium chloride (product of Alfa Aesar) was used as the first liquid instead of a mixed liquid of 18 g of styrene and 2 g of butyl acrylate. The resin particulates contained in the resultant suspension A-2 had a number average particle size of 30 nm and a glass transition point (Tg) of 68° C.

[Method for Manufacturing Toner G]

The toner G was manufactured according to the same method as the toner A in all aspects other than that the suspension B-1 was not used.

[Method for Manufacturing Toner H]

The toner H was prepared according to the same method as the toner A in all aspects other than that the amount of the suspension B-1 was changed from 1.2 g to 4.0 g in the shell layer formation process.

[Method for Manufacturing Toner I]

The toner I was manufactured according to the same method as the toner E in all aspects other than that the following changes.

In the shell layer formation process, 1.2 g of the suspension B-3 was used instead of 1.2 g of the suspension B-1. The suspension B-3 was prepared according to the same method as the suspension B-1 in all aspects other than that a negatively chargeable resin was prepared instead of a positively chargeable resin using 60 g of styrene, 60 g of methyl methacrylate, 15 g of butyl acrylate, and 0.2 mL of p-sodium styrenesulfonate (SPINOMAR NaSS (registered Japanese trademark) produced by TOSOH ORGANIC CHEMICAL CO., LTD.) instead of 100 g of methyl methacrylate, 35 g of butyl acrylate, and 30 g of [2-(methacryloyloxy)ethyl]trimethylammonium chloride. The resin particulates contained in the resultant suspension B-3 had a number average particle size of 37 nm and a glass transition point (Tg) of 75° C.

In the external addition process, 1.0 part by mass of silica particles (fumed silica particles subjected to surface treatment with polydimethylsiloxane: CAB-O-SIL (registered Japanese trademark) TS-720 produced by Cabot Corporation) were used instead of 1.0 part by mass of dry silica particulates (AEROSIL REA 90).

[Evaluation Method]

The following describes a method for evaluating respective samples (toners A-I).

(Charge Decay Characteristic)

The charge decay constant $\alpha$ of a sample (toner) was measured in accordance with Japan Industrial Standard (JIS) C 61340-2-1-2006 using an electrostatic diffusivity measuring device (NS-D100 produced by Nano Seeds Corporation). The following describes the method of measuring the charge decay constant of a toner.

The sample (toner) was placed into a measurement cell. The measurement cell was a metal cell with a recess having an inner diameter of 10 mm and a depth of 1 mm. The sample was filled in the recess of the cell by being thrust from above using a glass slide. Sample brimming over the cell was removed by reciprocating the glass slide on the surface of the cell. At least 0.04 g and no greater than 0.06 g of sample was filled in the cell.

Subsequently, the measurement cell in which the sample was filled was left for 12 hours in an environment at a temperature of 32° C. and a humidity of 80% RH. Thereafter, the measurement cell was grounded and placed in an electrostatic diffusivity measuring device. Ions were then supplied to the sample through corona discharge to charge the sample. The charging period was 0.5 seconds. After elapse of 0.7 seconds from completion of corona discharge, the surface potential of the sample was measured continuously. The charge decay constant (charge decay rate) $\alpha$ was calculated based on the measured surface potential and an equation $V=V_0\exp(-\alpha\sqrt{t})$. In the equation, V, $V_0$, and t represent a surface potential [V], an initial surface potential [V], and a decay period [second], respectively.

The charge decay characteristic of the sample (toner) was evaluated based on the calculated charge decay constant, in accordance with the following standard.

Excellent: Charge decay constant of no greater than 0.020

Good: Charge decay constant of greater than 0.020 and no greater than 0.025

Poor: Charge decay constant of greater than 0.025

(Charge Amount)

An evaluation developer (two-component developer) was prepared by mixing a developer carrier (carrier for TASKalfa 5550ci produced by KYOCERA Document Solutions Inc.) and a sample (toner) for 30 minutes using a ball mill. The ratio of the sample (toner) relative to the evaluation developer was 12% by mass. By contrast, a carrier for a negatively chargeable toner (carrier for Anesis 6016 produced by KYOCERA Document Solutions Inc.) was used as a developer carrier for evaluation of the toner I.

Subsequently, the charge amount of the toner in the evaluation developer was measured in each state in which the evaluation developer was left for 24 hours in an environment of normal temperature and normal humidity (N/N environment: temperature of 23° C. and humidity of 50% RH) and the evaluation developer was left for 24 hours in an environment of high temperature and high humidity (H/H environment: temperature of 32.5° C. and humidity of 80% RH). The charge amount of the toner in each developer was measured under the following conditions using a Q/m meter (MODEL 210 HS-1 produced by TREK, INC.).

<Method for Measuring Charge Amount of Toner in Developer>

A developer was supplied to a measurement cell of the Q/m meter, and only toner in the supplied developer was sucked through a sieve for 10 seconds. The charge amount (unit: μC/g) of the toner in the developer was calculated based on an expression "total electric amount (unit: μC) of sucked toner/mass (unit: g) of sucked toner".

The charge amount of the toner in the evaluation developer left in the N/N environment was evaluated in accordance with the following standard.

Good: The charge amount of at least +30 μC/g and no greater than −30 μC/g

Poor: The charge amount of no greater than −30 μC/g and less than +30 μC/g

The charge amount of the toner in the evaluation developer left in the H/H environment was evaluated in accordance with the following standard.

Good: The charge amount of at least +10 μC/g and no greater than −10 μC/g

Poor: The charge amount of no greater than −10 μC/g and less than +10 μC/g (FD: Fogging Density)

An evaluation developer (two-component developer) was prepared by the same method as that in the charge amount evaluation. The fogging density was measured on an image that was formed using an evaluation developer left in an environment of high temperature and high humidity (H/H environment: temperature of 32.5° C. and humidity of 80% RH) for 12 hours (hereinafter referred to as a developer after left in H/H).

A color multifunction peripheral (TASKalfa 5550ci produced by KYOCERA Document Solutions Inc.) was used as an evaluation apparatus. The developer after left in H/H was supplied to a developing device of the evaluation apparatus, and a sample (toner for replenishment) was supplied to a toner container of the evaluation apparatus. Further, a voltage between a developer sleeve and a magnet roll of the evaluation apparatus was adjusted to 200 V to 300 V such that initial image density (value measured using SpectroEye (registered Japanese trademark) produced by X-Rite Inc.) of an image was at least 1.0 and no greater than 1.2. By contrast, an analog copier (Anesis 6016 produced by KYOCERA Document Solutions Inc.) was used as an evaluation apparatus for evaluation of the toner I. In evaluation of the toner I, the surface potential of a photosensitive member and a voltage between a developing sleeve and a magnet roll of the evaluation apparatus were adjusted to +700V and +150V, respectively.

Subsequently, a sample image including a solid part and a blank part was printed on a recording medium (evaluation sheet) using the evaluation apparatus and respective reflection densities were measured on the blank part of the printed sample image on the recording medium and base paper not subjected to printing (non-printed sheet) using a reflectance densitometer (SpectroEye produced by X-Rite Inc.). The fogging density (FD) was then calculated based on the following expression.

FD=(reflection density of blank part)−(reflection density of non-printed sheet)

The image was evaluated in accordance with the following standard.

Good: The fogging density (FD) of no greater than 0.005

Poor: The fogging density (FD) of greater than 0.005

[Evaluation Results]

Evaluation results for each of the toners A-I are indicated in Table 2. Table 2 indicates evaluation results of the charge decay characteristic (charge decay constant), the N/N charge amount (charge amount of toner left in an environment of normal temperature and normal humidity), the H/H charge amount (charge amount of toner left in an environment of high temperature and high humidity), and the fogging density of each of the toners A-I.

TABLE 2

| | Toner | Charge decay | N/N Charge amount [μC/g] | H/H Charge amount [μC/g] | FD (H/H) |
|---|---|---|---|---|---|
| Example 1 | A | 0.018 | +42.3 | +15.4 | 0.002 |
| Example 2 | B | 0.015 | +32.3 | +10.3 | 0.004 |
| Example 3 | C | 0.020 | +57.3 | +11.2 | 0.004 |
| Example 4 | D | 0.018 | +42.3 | +12.0 | 0.003 |
| Example 5 | E | 0.017 | +30.8 | +12.5 | 0.004 |
| Example 6 | I | 0.014 | −32.1 | −14.6 | 0.002 |
| Comparative Example 1 | F | 0.084 (Poor) | +38.3 | −0.5 (Poor) | 0.014 (Poor) |
| Comparative Example 2 | G | 0.013 | +8.3 (Poor) | +5.3 (Poor) | 0.010 (Poor) |
| Comparative Example 3 | H | 0.043 (Poor) | +78.2 | −0.5 (Poor) | 0.010 (Poor) |

The toners A-E and I (toner according to Examples 1-6) each have the "basic features" and the "preferable shell features". Specifically, the toners according to Examples 1-6 each include shell layers each including a resin film and a plurality of resin particles. Further, the toners according to Examples 1-6 each generally has a configuration illustrated in FIG. 3A. Each of the shell layers of the toner particles in each toner has a surface including a plurality of spot regions and a sheet region that is more hydrophobic than the spot regions. The spot regions each are more chargeable than the sheet region.

When the toners A-E and I were examined through image analysis on SEM images, it was found that a ratio ($=S_B/S_A$) of the total area $S_B$ of each spot region relative to the total area $S_A$ of each sheet region was at least 0.01 and no greater than 0.20 on the surfaces of the shell layers in the respective toners A-E and I. A half or more of the spot regions have an equivalent circular diameter of at least 20 nm and no greater than 150 nm. The shell layers each cover at least 50% and no greater than 95% of the entire surface of a toner core. The image analysis on TEM images found that the resin films of the shell layers had a thickness of at least 1 nm and no greater than 30 nm.

As indicated in Table 2, the toners according to Examples 1-6 were sufficiently charged in both the environment of normal temperature and normal humidity and the environment of high temperature and high humidity. Further, an image having low fogging density could be formed with each of the toners according to Examples 1-6 even in the environment of high temperature and high humidity.

A charged region was formed in the entire surface of each shell layer in the toner F (toner according to Comparative Example 1). The reason thereof might be that the shell layers in the toner F contained a hydrophobic resin and a chargeable resin in a non-separated state.

The toner G (toner according to Comparative Example 2) did not have the basic features. It is considered that a chargeable and hydrophilic functional group was uniformly distributed on the surface of each toner particle of the toner G so that water molecules were adsorbed to the entire surface of each toner particle in the environment of high temperature and high humidity.

Charged regions on the surfaces of the shell layers in the toner H (toner according to Comparative Example 3) were too wide to be in a spot-like shape. The toner particles of the toner H ware weakly hydrophobic. Therefore, charge failure of the toner might have been caused in the environment of high temperature and high humidity to cause fogging on the formed image.

As indicated in Table 2, the toners F-H (Comparative Examples 1-3) were inferior to the toners A-E and I (Examples 1-6) in chargeability in an environment of high temperature and high humidity. Further, an image having low fogging density could not be formed in the environment of high temperature and high humidity with any of the toners F-H (toners according to Comparative Examples 1-3).

What is claimed is:

1. An electrostatic latent image developing toner comprising a plurality of toner particles each including a core and a shell layer disposed over a surface of the core, wherein the shell layer is substantially formed by a resin and has a surface including a plurality of spot regions and a sheet region that is more hydrophobic than the spot regions, the spot regions each are more chargeable than the sheet region, the shell layer includes a resin film substantially formed by a first resin and a plurality of resin particles substantially formed by a second resin, the first resin is more hydrophobic than the second resin, the second resin is more chargeable than the first resin, a part of the resin film that is exposed to the surface of the shell layer corresponds to the sheet region, respective parts of the resin particles that are exposed from the resin film correspond to the spot regions, the first resin is a copolymer of at least one of styrene-based monomer and at least one of acrylic acid-based monomer, and the second resin is a copolymer of at least one quaternary ammonium compound and at least one (meth)acrylic acid ester.

2. The electrostatic latent image developing toner according to claim 1, wherein the spot regions are distributed on the surface of the shell layer, and the spot regions are each surrounded by the sheet region.

3. The electrostatic latent image developing toner according to claim 1, wherein a repeating unit among repeating units included in the first resin that has a highest mole fraction is a repeating unit derived from a styrene-based monomer.

4. An electrostatic latent image developing toner comprising a plurality of toner particles each including a core and a shell layer disposed over a surface of the core, wherein the shell layer is substantially formed by a resin and has a surface including a plurality of spot regions and a sheet region that is more hydrophobic than the spot regions, the spot regions each are more chargeable than the sheet region, the shell layer includes a resin film substantially formed by a first resin and a plurality of resin particles substantially formed by a second resin, the first resin is more hydrophobic than the second resin, the second resin is more chargeable than the first resin, a part of the resin film that is exposed to the surface of the shell layer corresponds to the sheet region, respective parts of the resin particles that are exposed from the resin film correspond to the spot regions, the first resin is a copolymer of at least one of styrene-based monomer and at least one of acrylic acid-based monomer, and the second resin is a copolymer of at least one compound having either or both of a sulfo group and a salt thereof, at least one of styrene-based monomer, and at least one of (meth)acrylic acid ester.

5. The electrostatic latent image developing toner according to claim 1, wherein a repeating unit having a functional group capable of forming a salt through ionization or a salt thereof has a rate of no greater than 10% by mass relative to all repeating units included in the first resin.

6. The electrostatic latent image developing toner according to claim 1, wherein the shell layer further contains a thermosetting resin.

7. The electrostatic latent image developing toner according to claim 6, wherein the shell layer contains as the thermosetting resin, at least one of melamine-based resins, urea-based resins, and glyoxal-based resins.

8. The electrostatic latent image developing toner according to claim 1, wherein a ratio of a total mass of each resin contained in the resin particles is at least 1% by mass and no greater than 20% by mass relative to a total mass of each resin contained in the resin film.

9. The electrostatic latent image developing toner according to claim 1, wherein the core contains a polyester resin, and the resin film has a thickness of at least 1 nm and no greater than 30 nm.

10. The electrostatic latent image developing toner according to claim 4, wherein the core contains a polyester resin, and the resin film has a thickness of at least 1 nm and no greater than 30 nm.

11. The electrostatic latent image developing toner according to claim 1, wherein the second resin includes a repeating unit represented by formula (1) shown below or a salt thereof:

(1)

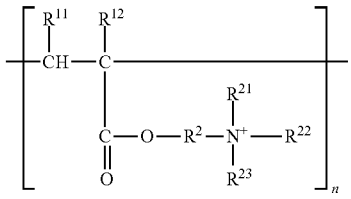

where, in formula (1), $R^{11}$ and $R^{12}$ each represent, independently of one another, a hydrogen atom, a halogen atom, or an optionally substituted alkyl group, $R^{21}$, $R^{22}$, and $R^{23}$ each represent, independently of one another, a hydrogen atom, an optionally substituted alkyl group, or an optionally substituted alkoxy group, and $R^{2}$ represents an optionally substituted alkylene group.

12. The electrostatic latent image developing toner according to claim 4, wherein the second resin includes a repeating unit represented by formula (2) shown below:

(2)

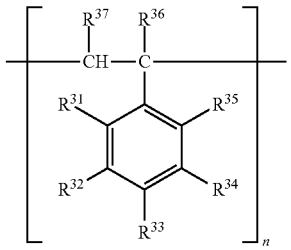

where, in formula (2), at least one of $R^{31}$-$R^{37}$ represents a sulfo group or a salt thereof and all other each represent, independently of one another, a hydrogen atom, a halogen atom, a hydroxyl group, an optionally substitute alkyl group, an optionally substitute alkoxy group, an optionally substituted alkoxy alkyl group, or an optionally substituted aryl group.

13. The electrostatic latent image developing toner according to claim 4, wherein the second resin is a copolymer of styrene, methyl methacrylate, butyl acrylate, and p-sodium styrenesulfonate.

* * * * *